United States Patent [19]

Davis et al.

[11] Patent Number: 4,700,695

[45] Date of Patent: Oct. 20, 1987

[54] MANDIBLE MOTION APPARATUS

[76] Inventors: Christopher L. Davis; Karlean M. Davis, both of 1712 Coral Pl., Seal Beach, Calif. 90740; Ralph C. Marshall, 539 E. Avenida, J-4, Lancaster, Calif. 93535

[21] Appl. No.: 895,362

[22] Filed: Aug. 11, 1986

[51] Int. Cl.[4] ..... A61H 1/02

[52] U.S. Cl. ..... 128/25 R; 272/95; 128/17

[58] Field of Search ..... 272/94, 95; 128/25 R, 128/12, 1, 20; 433/69

[56] References Cited

U.S. PATENT DOCUMENTS

| | | | |
|---|---|---|---|
| 2,061,936 | 11/1936 | Engelfried | 128/12 |
| 3,058,217 | 10/1962 | Joffe | 433/69 |
| 3,721,439 | 3/1973 | Rudolph et al. | 272/95 |
| 3,927,664 | 12/1975 | Georgiade et al. | 128/17 X |
| 4,306,861 | 12/1981 | Dickson | 433/69 |

*Primary Examiner*—Richard J. Apley
*Assistant Examiner*—J. Welsh
*Attorney, Agent, or Firm*—Jack C. Munro

[57] ABSTRACT

An apparatus to be attached onto the jaw of a human being to cause the jaw to continuously move between its open and closed position. The apparatus incluses a cam arrangement mounted in conjunction with the teeth of the jaw. The cam arrangement is to be continuously driven by a motor located exteriorly of the jaw to produce the continuous jaw movement.

5 Claims, 7 Drawing Figures

MANDIBLE MOTION APPARATUS

BACKGROUND OF THE INVENTION

The field of this invention relates to an apparatus which is to be connectable to an object to have that object continuously move in its normal mode of movement.

The jaw of a human being is designed so that the mandible, or lower jaw, normally moves between a closed position in juxtaposition with the maxilla, or upper jaw, to an open position which angularly displaces the mandible relative to the maxilla. Generally, movement of the jaw is taken for granted and is done almost continuously by human beings with the exception during sleep. In certain instances, due to medical reasons, it is necessary to have the jaw move continuously for a certain period of time such as for a few weeks.

If surgery on the jaw is required, particularly to the articular surfaces of the mandibular condyle and temporal fossa/eminence, there is a tendency during healing to create bony joint lesions. The creation of these lesions will interfere with normal jaw movement. It has been found that if the jaw is moved continuously after surgery for a few weeks that this movement will substantially prevent the creation of these lesions and, therefore, the jaw will have complete freedom of movement upon being completely healed.

In other instances, a certain individual may have a limited mouth opening due to muscle spasms, joint adhesions or other causes. It has also been found that if the jaw is constantly worked, the mandibular muscles will passively stretch and the problem of the limited mouth opening will be eliminated. In the past, the apparatus used to solve the problem of a limited mouth opening was merely to prop open the mouth through the use of tongue blades or the like.

Another problem has to do with burns in the area of the mouth. If the mouth area is permitted to heal during non-movement, usually a restricted oral opening will occur. Again, it has been found that if the jaw is continuously moved to its fully open extent, the mouth area will heal in an unrestricted manner.

Prior to the present invention there has not been known any apparatus which is designed specifically to achieve the constant movement of the jaw at all times, even while the individual sleeps.

SUMMARY OF THE INVENTION

An apparatus which includes recessed plates which are to be mounted on the teeth of the maxilla and also the teeth of the mandible. A pair of the recessed plates are to be mounted on the right side of the jaw, with a pair of the recessed plates being mounted on the left side of the jaw. Each pair of plates on each side of the jaw are in alignment. Each of the plates mounted on the upper jaw include a movable cam member. The plates on the lower jaw each include a groove which is to connect with a cam member. Fixedly secured to the front teeth of the jaw is a frontal support plate. A first cable is to be connected to one of the cam members with a second cable being connected to the other of the cam members. Both cables are conducted within a sheath with the sheath in turn being fixedly mounted onto the frontal support plate. The cables are connected to a motor which is located exteriorly of the mouth. The motor is to be electrically driven which will cause continuous movement of the cam members. This continuous movement of the cam members will result in constant normal movement of the mouth between its open and closed position. The amount of movement of the jaw can be controlled by the positioning of the recessed plates within the mouth. In other words, the more the recessed plates are positioned nearer to the rear of the mouth the greater the amount of movement of the jaw during operation of the apparatus.

The primary objective of the present invention is to construct an apparatus which will cause a jaw to continuously move between an open and closed position.

DETAILED DESCRIPTION OF THE SHOWN EMBODIMENT

Figure 2:
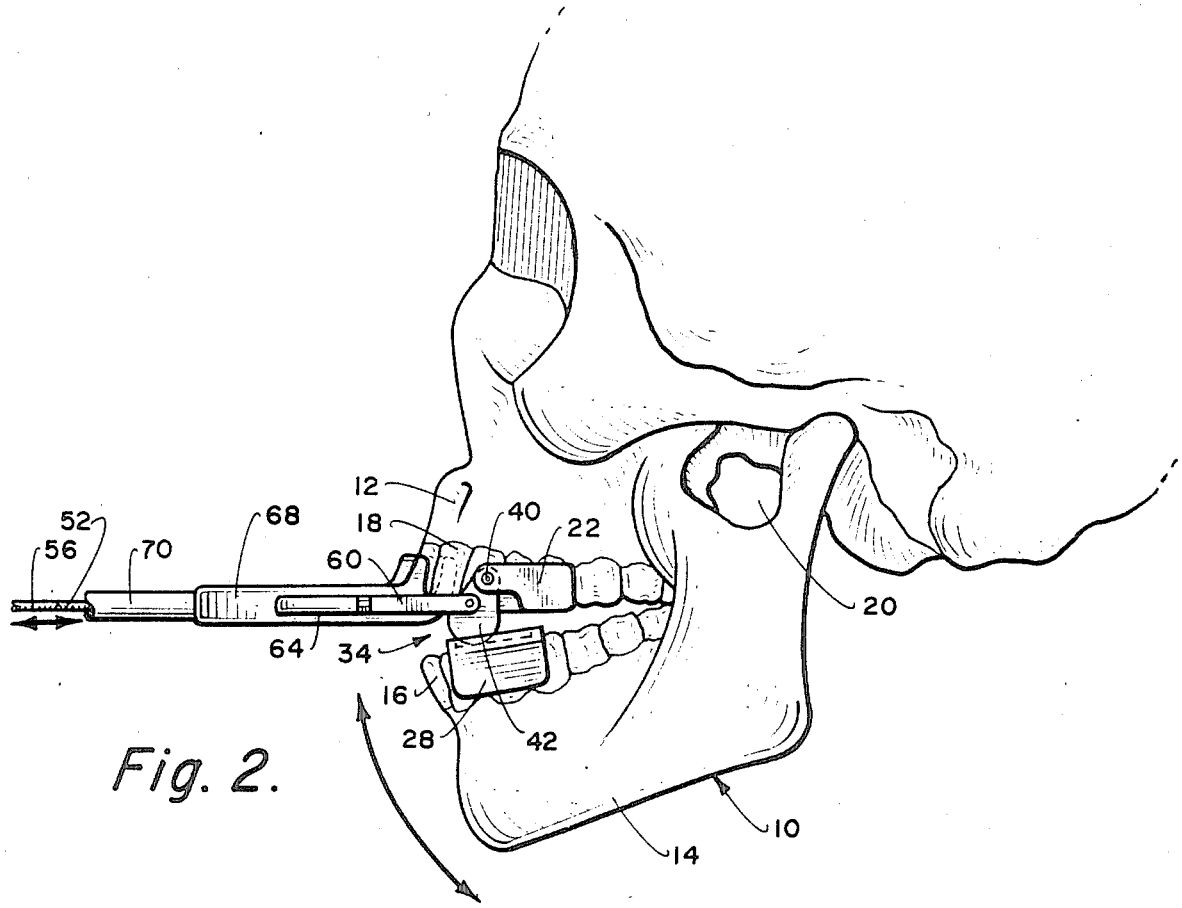
FIG. 2 is a view similar to FIG. 1, but showing the jaw in a partially open position.
Figure 3:
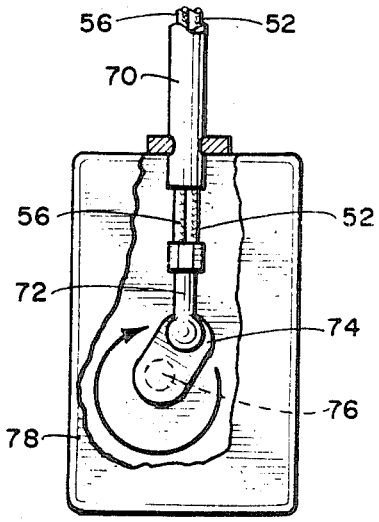
FIG. 3 is an elevational view depicting connection of the cable assembly to a motor for moving the cam members incorporated within the apparatus of the present invention.
Figure 4:
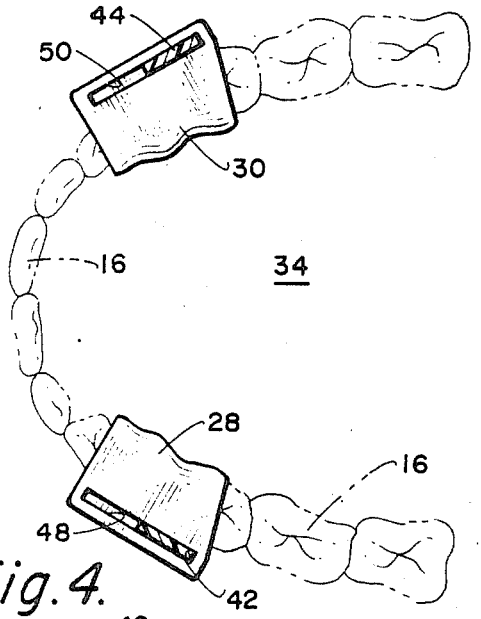
FIG. 4 is a top plan view of the mandible section of the apparatus of the present invention taken along line 4—4 of FIG. 1.
Figure 5:
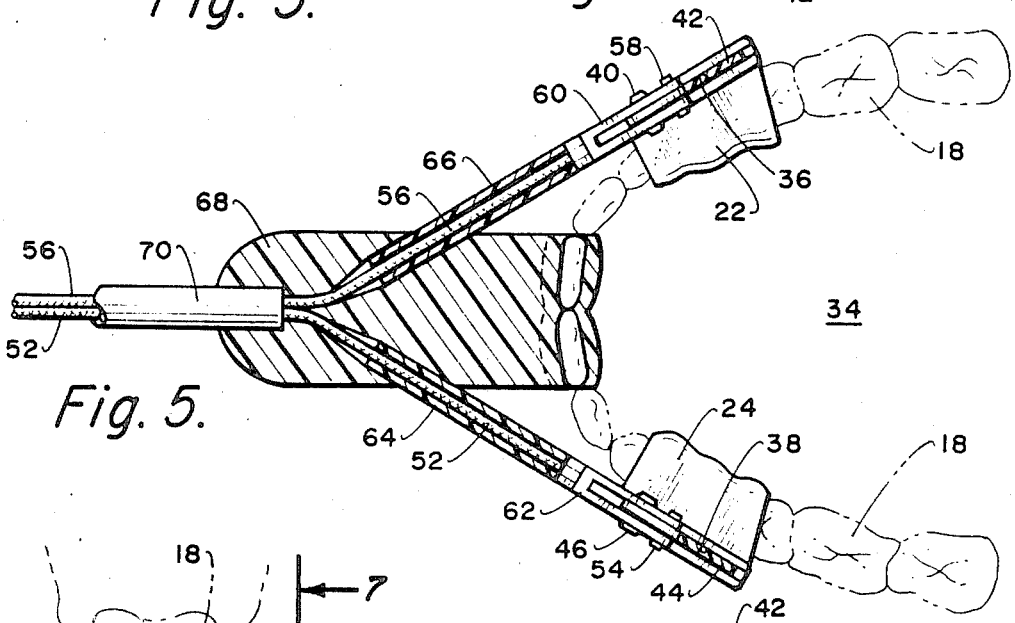
FIG. 5 is a bottom plan view of the maxilla section of the apparatus of this invention taken along line 5—5 of FIG. 1.
Figure 6:
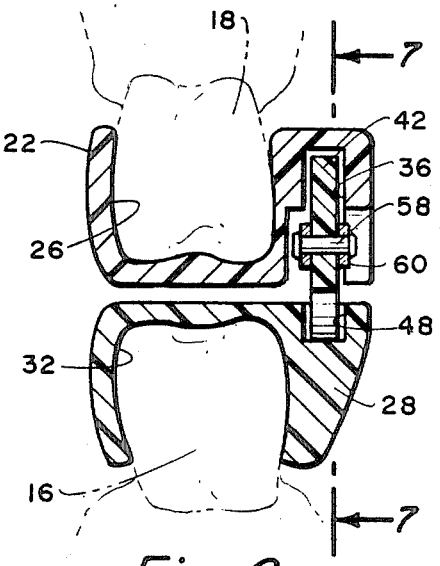
FIG. 6 is a cross-sectional view taken through the apparatus of this invention taken along line 6—6 of FIG. 1.
Figure 7:
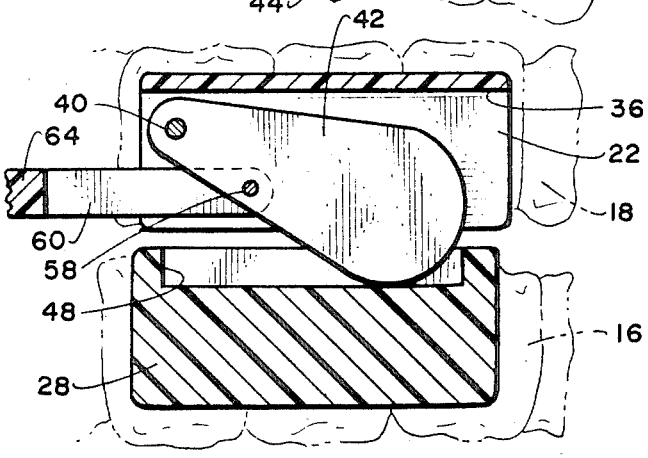
FIG. 7 is a cross-sectional view taken along line 7—7 of FIG. 6.

Referrring particularly to the drawings there is shown a jaw 10 which is composed of a maxilla 12 and a mandible 14. The mandible (lower jaw) 14 includes teeth 16. The maxilla (upper jaw) 12 includes teeth 18. The maxilla 12 and the mandible 14 are brought into opposition through movement in the jawbone joint 20 comprising the mandibular condyle and temporal fossa. The joint 20 permits angular displacement of the mandible 14 relative to the maxilla 12 such as shown in FIG. 2 of the drawings.

On the left side of the jaw and on the teeth 18 there is mounted a housing in the form of a recessed plate 22. On the right side of the jaw there is mounted on the teeth 18 a second recessed plate 24. The recessed plates 22 and 24 are basically mirror images of each other and each of the plates 22 and 24 include an enlarged recess 26. The recessed plates 22 and 24 will normally be constructed of a metal or plastic material. However, it is desired that the plates 22 and 24 have a certain amount of resiliency so that the plates 22 and 24 will frictionally engage with the teeth when the teeth are located within the recess 26. This resilient action firmly holds the plates 22 and 24 in place.

A similar pair of recessed plates 28 and 30 are respectively mounted on the left and right sides of the jaw and on the teeth 16. The recessed plates 28 and 30 also include an enlarged recess 32 which again is to resiliently frictionally engage with the teeth 16 so as to firmly hold such in place. The recessed plates 28 and 30 are to be aligned respectively with the recessed plates 22 and 24.

It is to be understood that it is the option of the installer to select at what position the plates 22, 24, 28 and 30 are mounted within the mouth 34. As it will become apparent further on in this description, that if the plates are mounted more to the rear of the teeth 16 and 18, a greater amount of angular movement wall occur of the mandible 14 relative to the maxilla 12. If the plates are mounted closer to the front of the mouth, a smaller amount of angular movement will be obtained, such as is shown within FIG. 2.

Figure 1:
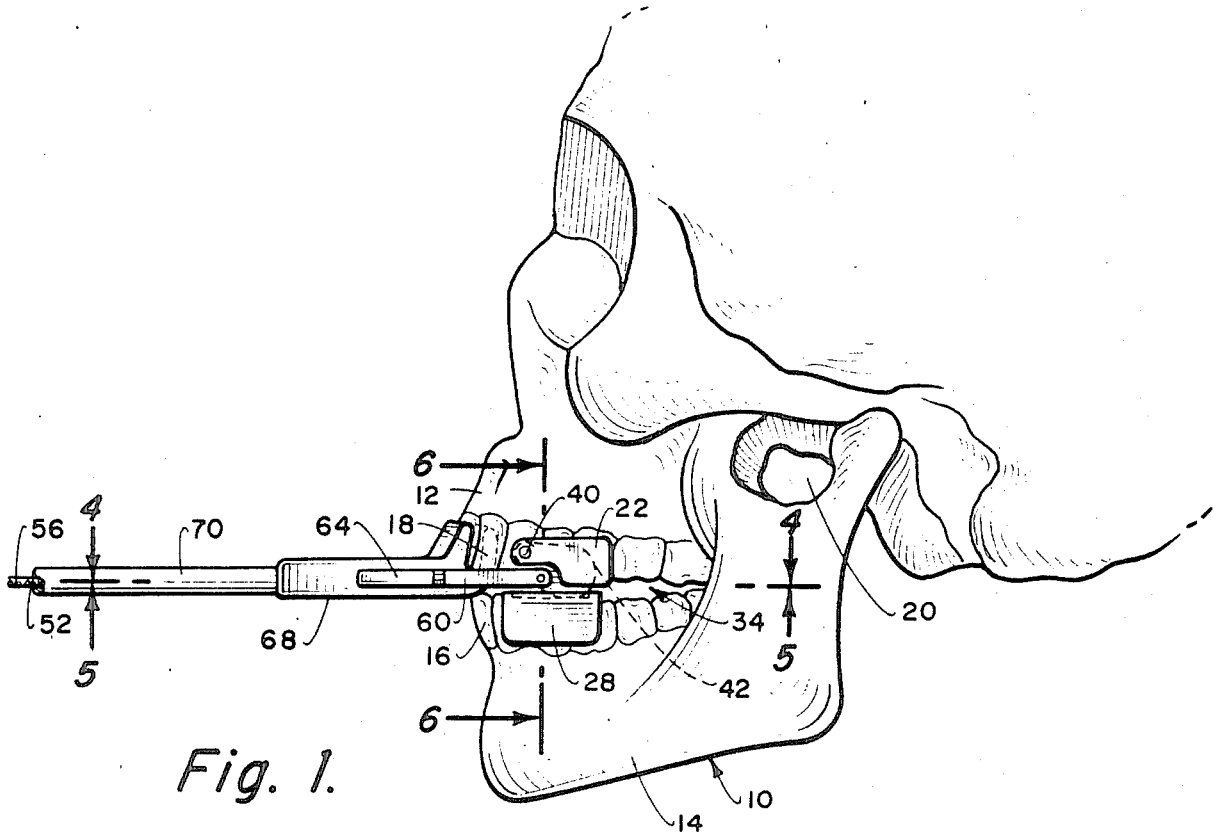
FIG. 1 is a side elevational view of a jaw of a human being in its closed position upon which has been mounted the apparatus of the present invention.

Integrally formed with the exterior will surface of the plate 22 is a slot 36. A similar slot 38 is integrally formed on the exterior surface of the plate 24. Pivotally mounted by a pivot pin 40 to the plate 22 is a cam member 42. This cam member 42 is basically of sheet material construction and is in the shape of a teardrop. Cam member 42 is located within the groove 36. The cam member 42 is capable of pivoting from an upper position shown in FIG. 1 of the drawings, to a lower position shown in FIG. 2 of the drawings on the plate 22. It is to be understood that there is a similar shaped cam member 44 located within the slot 38 which is also pivotable by pivot pin 46 on the plate 24.

Formed within the exterior surface of the plate 28 is a groove 48. Cam member 42 rides within the groove 48. A similar groove 50 is formed within the exterior wall surface of the plate 30 with the cam member 44 riding within this groove 50.

An end of a cable 52 is attached to a bifurcated member 62 which is then mounted by pin 54 to the cam member 44. A similar cable 56 is attached to bifurcated member 60 which is connected by a pin 58 to the cam member 42. Bifurcated member 60 is pivotally mounted by the pin 58 to the cam member 42. Bifurcated member 62 is pivotally mounted by the pin 54 to the cam member 44.

Mounted directly adjacent the bifurcated member 62 and covering the portion of the cable 52 located directly adjacent to the bifurcated member 62 is a short sheath 64. A similar short sheath 66 covers the cable 56 located directly adjacent the bifurcated member 60. Normally, it will be desirable to fixedly secure the sheaths 64 and 66 to the front support plate 68. The cables 52 and 56, after leaving their respective short sheaths 64 and 66, are located side-by-side within a main sheath 70. This main sheath 70 is also fixedly secured to the front support plate 68.

The front support plate 68 is to be formed of plastic or other similar type of material and is to be snapped onto or otherwise engage with the front portion of the teeth 18. The front support plate 68 will include recesses within which the teeth are to be frictionally held in position.

The outer end of both cables 52 and 56 are fixedly secured to an actuating rod 72. This actuating rod 72 is pivotally mounted onto a plate 74. This plate 74 is fixedly secured to a shaft 76 of a motor mounted within a motor housing 78. The motor will normally be electrically driven and will normally be operated by a battery pack which can be readily carried on the body of the individual using the apparatus of this invention. Included within the motor housing 78, where appropriate, is an on-off switch (not shown).

In order to install the apparatus of this invention, it is merely necessary for the operator to snap in position the plates 22, 24, 28 and 30 as well as the front support plate 68. Activation of the motor by the on/off switch on the motor housing 78 will cause the plate 74 to continuously rotate three hundred sixty degrees. This continuous rotation will cause reciprocating movement of the cables 52 and 56. This reciprocating movement will be no more than about a quarter to three-eighths of an inch. This reciprocating movement will cause the cam members 42 and 44 to pivot about their respective pivot pins 40 and 46 between the position shown in FIG. 1 to the position shown in FIG. 2 of the drawings. This reciprocating movement will cause the mandible 14 to most often be angularly displaced relative to the maxilla 12. As a result, the mouth 34 will be continuously opened and closed.

It is to be understood that the apparatus of this invention will be utilized by an individual not only during the daytime hours but also probably during the nighttime hours. In actual practice, the nighttime usage may even exceed daytime usage. It is to be understood that when the individual eats or drinks that the apparatus 10 of this invention will be removed from the mouth 34.

Although the recessed plates 22 and 24 are shown to be separate, it may be found to be desirable to connect the plates 22 and 24 by a custom design splint (not shown) which fits over in a snug-fitting manner the entire upper teeth 18. In this particular situation, the frontal support plate 68 would be connected to this splint. In a similar manner, a splint would be utilized to connect the recessed plates 28 and 30. This splint would be mounted on the lower teeth 16.

Although the driving apparatus has been defined as an electrical motor, it is considered to be within the scope of this invention to use other types of motor means such as hydraulic or pneumatic pistons. also, it is considered to be within the scope of this invention that structure could be utilized to vary the amount of lifting that is obtained during movement of cam members 42. One way in which this lifting amount can be altered is by incorporating an adjustment within the plate 74. This adjustment could increase or decrease the distance between the rod 72 and the shaft 76 which in turn will vary the amount of lift that occurs at the cam members 42 and 44. Additionally, it may be found to be desirable to incorporate a lateral motion of the jaw rather than just having only a straight up-and-down jaw motion. This could be easily obtained by canting of the cam members 42 and 44 at a non-vertical position. Therefore, during movement of the cam members 42 and 44, there will be imparted lateral movement of the lower jaw 14 relative to the upper jaw 12.

What is claimed is:

1. A mandible motion apparatus to continuously move the lower jaw relative to the upper jaw of a user, said mandible motion apparatus comprising:

first means for mounting onto the upper jaw;

second means for mounting onto the lower jaw;

cam means connected to said first and second means, said cam means being movable between a first position and a second position, with said cam means in said first position the lower jaw being closed and located in juxtaposition with the upper jaw, with the cam means in said second position the lower jaw being open and angularly displaced relative to the upper jaw; and motor means connected to said cam means, operation of said motor means causes constant repetitive movement of said cam means between said first and second positions.

2. The mandible motion apparatus as defined in claim 1 wherein:

said first means and said second means including attachment means adapted to be fixedly secured to the teeth of the user.

3. The mandible motion apparatus as defined in claim 2 wherein:

said attachment means for both said first and said second means including a recessed housing which is adapted to be mounted onto said teeth and frictionally engage therewith.

4. The mandible motion apparatus as defined in claim 1 wherein:

said motor means including a cable assembly and a motor, said cable assembly connected between said cam means and said motor.

5. The mandible motion apparatus as defined in claim 4 including:

front support means adapted to be mounted on said upper jaw, said cable assembly having a sheath, said sheath being fixedly secured to said front support means, a cable being mounted within said sheath, said cable being directly connected to said cam means with said sheath terminating at said front support means, said cable to move relative to said sheath as said cam means moves between said first and second position.

* * * * *